US005972084A

United States Patent [19]

Lacroix et al.

[11] Patent Number: 5,972,084

[45] Date of Patent: Oct. 26, 1999

[54] PROCESS FOR PRINTING TEXTILE FIBER MATERIALS IN ACCORDANCE WITH THE INK-JET PRINTING PROCESS

[75] Inventors: Roger Lacroix, Village-Neuf; Mickael Mheidle, Sausheim, both of France; Peter Scheibli, Bottmingen, Switzerland

[73] Assignee: Ciba Specialty Chemicals Corporation, Tarrytown, N.Y.

[21] Appl. No.: 09/089,144

[22] Filed: Jun. 2, 1998

[30] Foreign Application Priority Data

Jun. 17, 1997 [CH] Switzerland ..... 1475/97

[51] Int. Cl.[6] ..... C09D 11/02; C09D 11/14

[52] U.S. Cl. ..... 106/31.36; 106/31.37; 106/31.47; 106/31.48; 106/31.49; 106/31.52

[58] Field of Search ..... 106/31.36, 31.37, 106/31.47, 31.48, 31.49, 31.52

[56] References Cited

U.S. PATENT DOCUMENTS

| | | | |
|---|---|---|---|
| 4,737,190 | 4/1988 | Shimada et al. | 106/31.47 |
| 5,250,121 | 10/1993 | Yamamoto et al. | 106/31.47 |
| 5,383,960 | 1/1995 | Gregory et al. | 106/31.48 |
| 5,584,918 | 12/1996 | Suzuki et al. | 106/31.47 |
| 5,616,694 | 4/1997 | Kenyon et al. | 106/31.48 |
| 5,843,217 | 12/1998 | Ueda et al. | 106/31.48 |

FOREIGN PATENT DOCUMENTS 0534428 3/1993 European Pat. Off. .

OTHER PUBLICATIONS

Derwent Abstract 85–273488/44, for JP60/185886, Sep. 1985.

Derwent Abstract 86–249864/38, for JP61/179269, 1986, no month available.

*Primary Examiner*—Helene Klemanski

*Attorney, Agent, or Firm*—Kevin T. Mansfield; David R. Crichton

[57] ABSTRACT

A process for printing textile fiber materials in accordance with the ink-jet printing process, wherein the fiber materials are printed with an aqueous ink comprising a) at least one reactive dye of formula (1)

or at least one reactive dye of formula (2)

wherein the substituents are as defined in claim 1, and b) a water-soluble, non-ionic cellulose ether or an alginate.

15 Claims, No Drawings

PROCESS FOR PRINTING TEXTILE FIBER MATERIALS IN ACCORDANCE WITH THE INK-JET PRINTING PROCESS

PROCESS FOR PRINTING TEXTILE FIBRE MATERIALS IN ACCORDANCE WITH THE INK-JET PRINTING PROCESS

The present invention relates to a process for printing textile fibre materials using reactive dyes in accordance with the ink-jet printing process (jet and ink-jet processes) and to the inks used for that process.

Ink-jet printing processes have been used in the textile industry for some years. Such processes make it possible to dispense with the otherwise customary production of a printing screen, so that considerable savings can be made in terms of cost and time. Especially in the case of the production of pattern originals it is possible to respond to a change in requirements within a significantly shorter period of time.

Such ink-jet printing processes should especially have optimum characteristics from the standpoint of application technology. In this connection mention may be made of characteristics such as the viscosity, stability, surface-tension and conductivity of the inks used. Furthermore, higher demands are being made of the quality of the resulting prints, e.g. in respect of colour strength, fibre-dye bond stability and fastness to wetting. Those demands are not met by the known processes in all characteristics, so that there is still a need for new processes for the ink-jet printing of textiles.

The invention relates to a process for printing textile fibre materials in accordance with the ink-jet printing process, wherein the fibre materials are printed with an aqueous ink comprising a) at least one reactive dye of formula (1)

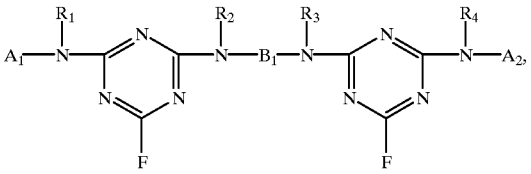

wherein $R_1$, $R_2$, $R_3$ and $R_4$ are each independently of the others hydrogen or unsubstituted or substituted $C_1$–$C_4$alkyl, $B_1$ is an organic bridge member, $A_1$ is the radical of a monoazo, polyazo, metal-complexed azo, anthraquinone, phthalocyanine, formazan or dioxazine chromophore having at least one sulfo group, and $A_2$ is as defined for $A_1$ or is hydrogen or unsubstituted or substituted $C_1$–$C_4$alkyl, phenyl or naphthyl, or at least one reactive dye of formula (2)

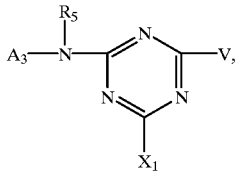

wherein $R_5$ is hydrogen or unsubstituted or substituted $C_1$–$C_4$alkyl, $X_1$ is halogen, $A_3$ is the radical of a monoazo, polyazo, metal-complexed azo, anthraquinone, phthalocyanine, formazan or dioxazine chromophore having at least one sulfo group, and V is a fibre-reactive radical of formula (3a)

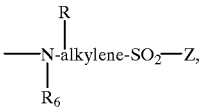

(3b)

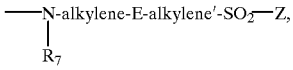

(3c)

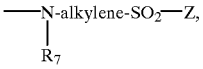

(3d)

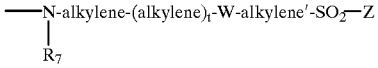

or (3e)

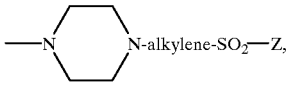

wherein alkylene and alkylene' are each independently of the other $C_1$–$C_6$alkylene, arylene is a phenylene or naphthylene radical that is unsubstituted or substituted by sulfo, carboxy, $C_1$–$C_4$alkyl, $C_1$–$C_4$alkoxy or by halogen, Z is vinyl or a radical $-CH_2-CH_2-U_1$ and $U_1$ is a leaving group, R is hydrogen, hydroxy, sulfo, sulfato, carboxy, cyano, halogen, $C_1$–$C_4$alkoxycarbonyl, $C_1$–$C_4$-alkanoyloxy, carbamoyl or the group $-SO_2-Z$, $R_6$ is hydrogen, $C_1$–$C_4$alkyl that is unsubstituted or substituted by hydroxy, sulfo, sulfato, carboxy or by cyano, or a radical of the formula

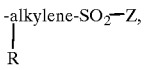

$R_7$ is hydrogen or $C_1$–$C_4$alkyl that is unsubstituted or substituted by carboxy, cyano, hydroxy, sulfo or by sulfato, E is the radical -O- or $-NR_8-$ and $R_8$ is hydrogen or $C_1$–$C_4$alkyl, W is a group of the formula $-SO_2-NR_6-$, $-CONR_6-$ or $-NR_6CO-$ and $R_6$ is as defined above, and t is 0 or 1, and b) a water-soluble, non-ionic cellulose ether or an alginate.

The radicals $R_1$, $R_2$, $R_3$, $R_4$ and $R_5$ as alkyl radicals may be further substituted e.g. by hydroxy, sulfo, sulfato, cyano or carboxy. $R_1$, $R_2$, $R_3$, $R_4$ and $R_5$ are preferably each independently of the others hydrogen or $C_1$–$C_4$alkyl, especially hydrogen.

$X_1$ is preferably chlorine or especially fluorine.

The following come into consideration as organic bridge members $B_1$, for example:

$C_2$–$C_{12}$alkylene radicals, especially $C_2$–$C_6$alkylene radicals, which may be interrupted by 1, 2 or 3 members from the group -NH-, $-N(CH_3)-$ and -O-, especially -O-, and are unsubstituted or substituted by hydroxy, sulfo, sulfato, cyano or by carboxy, preferred substituents of the alkylene radicals mentioned for B, being hydroxy, sulfo and sulfato, especially hydroxy;

$C_5$–$C_9$cycloalkylene radicals, such as especially cyclohexylene radicals, that are unsubstituted or substituted by $C_1$–$C_4$alkyl, $C_1$–$C_4$alkoxy, $C_2$–$C_4$alkanoylamino, sulfo, halogen or by carboxy, especially by $C_1$–$C_4$alkyl;

methylene-cyclohexylene-methylene radicals that are unsubstituted or substituted in the cyclohexylene ring by $C_1$–$C_4$alkyl;

$C_1$–$C_6$alkylenephenylene, or preferably phenylene, that is unsubstituted or substituted by $C_1$–$C_4$alkyl, $C_1$–$C_4$alkoxy, $C_2$–$C_4$alkanoylamino, sulfo, halogen or by carboxy.

Also suitable as a radical of formula $-N(R_2)-B_1-N(R_3)-$ is a radical of the formula

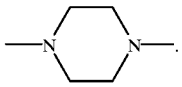

Preferably $B_1$ is a $C_2$–$C_{12}$alkylene radical which may be interrupted by 1, 2 or 3 members from the group -NH-, $-N(CH_3)-$ and -O- and is unsubstituted or substituted by hydroxy, sulfo, sulfato, cyano or by carboxy; or a phenylene radical that is unsubstituted or substituted by $C_1$–$C_4$alkyl, $C_1$–$C_4$alkoxy, $C_2$–$C_4$-alkanoylamino, sulfo, halogen or by carboxy.

$B_1$ is especially a $C_2$–$C_{12}$alkylene radical which may be interrupted by 1, 2 or 3 members from the group -NH-, $-N(CH_3)-$ and -O-, especially -O-, and is unsubstituted or substituted by hydroxy, sulfo, sulfato, cyano or by carboxy. The alkylene radical is preferably unsubstituted or substituted by hydroxy, sulfo or by sulfato, especially by hydroxy.

$B_1$ is more especially a $C_2$–$C_{12}$alkylene radical, especially a $C_2$–$C_6$alkylene radical, which may be interrupted by 1, 2 or 3 -O- members and is unsubstituted or substituted by hydroxy.

Bridge members $B_1$ of special interest are $C_2$–$C_6$alkylene radicals.

Alkylene and alkylene' are each independently of the other, for example, a methylene, ethylene, 1,3-propylene, 1,4-butylene, 1,5-pentylene or 1,6-hexylene radical or a branched isomer thereof.

Alkylene and alkylene' are preferably a $C_2$–$C_3$alkylene radical and especially an ethylene radical.

Arylene is preferably a 1,3- or 1,4-phenylene radical that is unsubstituted or substituted, for example, by sulfo, methyl, methoxy or carboxy.

The leaving group $U_1$ is, for example, -Cl, -Br, -F, $-OSO_3H$, $-SSO_3H$, $-OCO-CH_3$, $-OPO_3H_2$, $-OCO-C_6H_5$, $-OSO_2-C_1$–$C_4$alkyl or $-OSO_2-N(C_1$–$C_4$alkyl$)_2$. $U_1$ is preferably a group of the formula -Cl, $-OSO_3H$, $-SSO_3H$, $-OCO-CH_3$, $-OCO-C_6H_5$ or $-OPO_3H_2$, especially -Cl or $-OSO_3H$ and more especially $-OSO_3H$.

Z is preferably vinyl or a radical of the formula $-CH_2-CH_2-OSO_3H$, especially vinyl.

E is preferably -NH- or especially -O-.

W is preferably a group of the formula -NHCO- or especially -CONH-.

R is preferably hydrogen or the group $-SO_2-Z$, wherein Z is subject to the definitions and preferences indicated above. R is especially hydrogen.

$R_6$ is preferably hydrogen, $C_1$–$C_4$alkyl or a group -alkylene-$SO_2$-Z, wherein alkylene and Z are each as defined above. $R_6$ is especially hydrogen or $C_1$–$C_4$alkyl, more especially hydrogen.

$R_7$ is preferably hydrogen or a $C_1$–$C_4$alkyl radical and especially hydrogen.

t is preferably the number 0.

Special interest is accorded to fibre-reactive radicals V wherein alkylene and alkylene' are each independently of the other $C_2$–$C_3$alkylene, $R_7$ is hydrogen, Z is vinyl or a radical of the formula $-CH_2-CH_2-OSO_3H$, especially vinyl, E is the radical -O-, W is a group of the formula -CONH- and t is the number 0.

Arylene in this instance is preferably a 1,3- or 1,4-phenylene radical that is unsubstituted or substituted, for example, by sulfo, methyl, methoxy or by carboxy.

R and $R_6$ in this instance are preferably hydrogen.

Preferred fibre-reactive radicals V are those of formulae (3b) to (3d), especially of formula (3b) or (3d) and preferably of formula (3b).

When $A_2$ is unsubstituted or substituted $C_1$–$C_4$alkyl, phenyl or naphthyl, it may be, for example, $C_1$–$C_4$alkyl that is unsubstituted or substituted by sulfo, sulfato, hydroxy, carboxy or by phenyl; or phenyl or naphthyl each of which is unsubstituted or substituted by $C_1$–$C_4$alkyl, $C_1$–$C_4$alkoxy, carboxy, sulfo or by halogen. Preference is given to phenyl that is unsubstituted or substituted by $C_1$–$C_4$alkyl, $C_1$–$C_4$alkoxy, carboxy, sulfo or by halogen.

$A_2$ is preferably the radical of a monoazo, polyazo, metal-complexed azo, anthraquinone, phthalocyanine, formazan or dioxazine chromophore having at least one sulfo group.

A radical $A_1$, $A_2$ or $A_3$ as the radical of a monoazo, polyazo, metal-complexed azo, anthraquinone, phthalocyanine, formazan or dioxazine chromophore may have the substituents customary in organic dyes bonded to its base structure.

The following may be mentioned as examples of substituents in the radicals $A_1$, $A_2$ and $A_3$: alkyl groups having from 1 to 4 carbon atoms, such as methyl, ethyl, propyl, isopropyl or butyl, it being possible for the alkyl radicals to be further substituted e.g. by hydroxy, sulfo or by sulfato; alkoxy groups having from 1 to 4 carbon atoms, such as methoxy, ethoxy, propoxy, isopropoxy or butoxy, it being possible for the alkyl radicals to be further substituted e.g. by hydroxy, sulfo or by sulfato; phenyl that is unsubstituted or substituted by $C_1$–$C_4$alkyl, $C_1$–$C_4$alkoxy, halogen, carboxy or by sulfo; acylamino groups having from 1 to 8 carbon atoms, especially such alkanoylamino groups, e.g. acetylamino or propionylamino; benzoylamino that is unsubstituted or substituted in the phenyl ring by $C_1$–$C_4$alkyl, $C_1$–$C_4$alkoxy, halogen or by sulfo; phenylamino that is unsubstituted or substituted in the phenyl ring by $C_1$–$C_4$alkyl, $C_1$–$C_4$alkoxy, halogen or by sulfo; N,N-di-β-hydroxyethylamino; N,N-di-β-sulfato-ethylamino; sulfobenzylamino; N,N-disulfobenzylamino; alkoxycarbonyl having from 1 to 4 carbon atoms in the alkoxy radical, such as methoxycarbonyl or ethoxycarbonyl; alkylsulfonyl having from 1 to 4 carbon atoms, such as methylsulfonyl or ethylsulfonyl; trifluoromethyl; nitro; amino; cyano; halogen, such as fluorine, chlorine or bromine; carbamoyl; N-alkylcarbamoyl having from 1 to 4 carbon atoms in the alkyl radical, such as N-methylcarbamoyl or N-ethylcarbamoyl; sulfamoyl; N-mono- or N,N-di-alkylsulfamoyl each having from 1 to 4 carbon atoms, such as N-methylsulfamoyl, N-ethylsulfamoyl, N-propylsulfamoyl, N-isopropylsulfamoyl or N-butylsulfamoyl, it being possible for the alkyl radicals to be further substituted e.g. by hydroxy or by sulfo; N-(β-hydroxyethyl)-sulfamoyl; N,N-di(β-hydroxyethyl)-sulfamoyl; N-phenylsulfamoyl that is unsubstituted or substituted by $C_1$–$C_4$alkyl, $C_1$–$C_4$alkoxy, halogen, carboxy or by sulfo; ureido; hydroxy; carboxy; sulfomethyl or sulfo, and fibre-reactive radicals.

Examples of such fibre-reactive radicals include those of the formula -NH-CO-Y and especially $-SO_2$-Z, wherein Z is subject to the definitions and preferences indicated above and Y is a radical of the formula $-CH(Hal)-CH_2-Hal$ or $-C(Hal)=CH_2$ and Hal is halogen, especially chlorine or preferably bromine.

When $A_1$, $A_2$ and $A_3$ are the radical of a monoazo, polyazo or metal-complexed azo chromophore, the following radicals, especially, come into consideration:

Chromophore radicals of a mono- or dis-azo dye of formula $$D\text{-}N{=}N\text{-}(M\text{-}N{=}N)_u\text{-}K\text{-}, \tag{4a}$$

$$\text{-}D\text{-}N{=}N\text{-}(M\text{-}N{=}N)_u\text{-}K, \tag{4b}$$

wherein D is the radical of a diazo component of the benzene or naphthalene series, M is the radical of a middle component of the benzene or naphthalene series, K is the radical of a coupling component of the benzene, naphthalene, pyrazolone, 6-hydroxypyridone-(2) or acetoacetic acid arylamide series and u is the number 0 or 1, it being possible in the case of azo dyes for D, M and K to carry customary substituents, e.g. $C_1$–$C_4$alkyl or $C_1$–$C_4$alkoxy each of which is unsubstituted or may be further substituted by hydroxy, sulfo or by sulfato; halogen; carboxy; sulfo; nitro; cyano; trifluoromethyl; sulfamoyl; carbamoyl; amino; ureido; hydroxy; carboxy; sulfomethyl; $C_2$–$C_4$alkanoylamino; benzoylamino that is unsubstituted or substituted in the phenyl ring by $C_1$–$C_4$alkyl, $C_1$–$C_4$alkoxy, halogen or by sulfo; phenyl that is unsubstituted or substituted by $C_1$–$C_4$alkyl, $C_1$–$C_4$alkoxy, halogen, carboxy or by sulfo; and fibre-reactive radicals. Also suitable are the metal complexes derived from the above dye radicals of formulae (4a) and (4b), especially dye radicals of a 1:1 copper-complexed azo dye of the benzene or naphthalene series wherein the copper atom is bonded to a group capable of metallation, e.g. a hydroxy group, on each side in the ortho-position to the azo bridge. If a chromophore radical of formula (4a) or (4b) carries a reactive radical, that radical preferably corresponds to the formula $-SO_2Z$ indicated above.

The radicals of formulae (4a) and (4b) are preferably those of formula (5a)

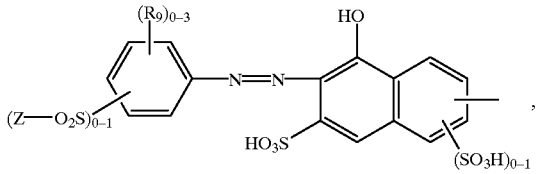

wherein $(R_9)_{0-3}$ denotes from 0 to 3 identical or different substituents from the group $C_1$–$C_4$alkyl, $C_1$–$C_4$alkoxy, halogen, carboxy and sulfo and Z is as defined above, (5b)

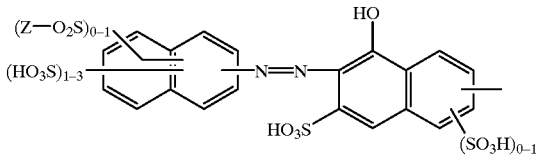

wherein Z is as defined above, (5c)

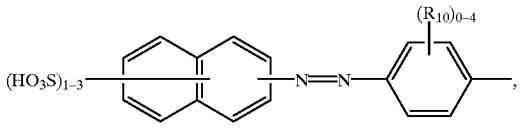

wherein $(R_{10})_{0-4}$ denotes from 0 to 4 identical or different substituents from the group halogen, nitro, cyano, trifluoromethyl, sulfamoyl, carbamoyl, $C_1$–$C_4$alkyl, $C_1$–$C_4$alkoxy, amino, acetylamino, ureido, hydroxy, carboxy, sulfomethyl and sulfo and Z is as defined above, (5d)

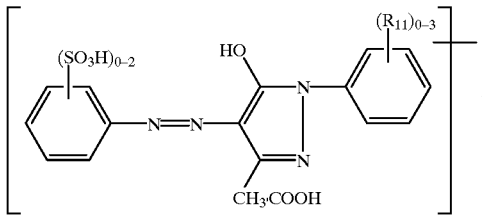

wherein $(R_{11})_{0-3}$ denotes from 0 to 3 identical or different substituents from the group $C_1$–$C_4$alkyl, $C_1$–$C_4$alkoxy, halogen, carboxy and sulfo, (5e)

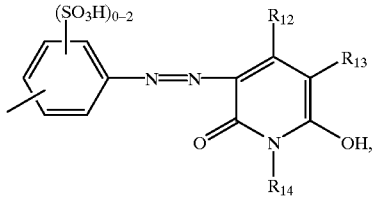

wherein $R_{12}$ and $R_{14}$ are each independently of the other hydrogen, $C_1$–C4alkyl or phenyl, and $R_{13}$ is hydrogen, cyano, carbamoyl or sulfomethyl, (6a)

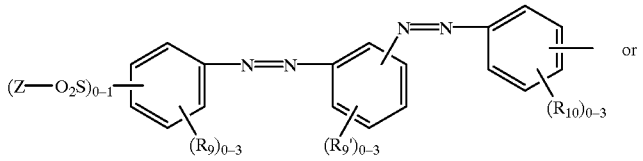

or (6b)

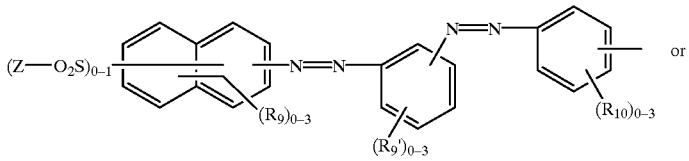

or (6c)

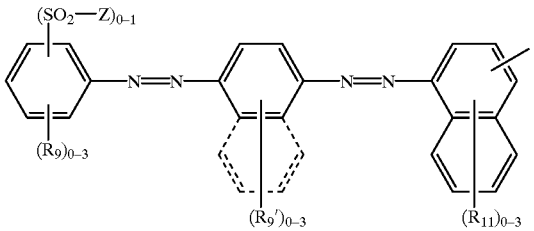

or (6d)

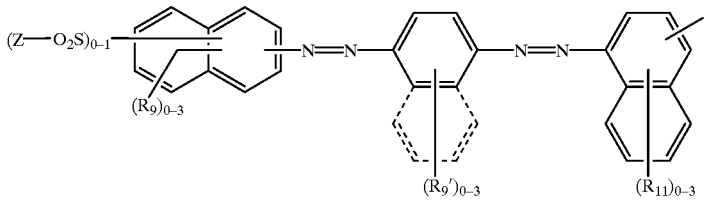

, wherein $(R_9)_{0-3}$, $(R_{10})_{0-3}$, $(R_{11})_{0-3}$ and Z are each as defined above and $(R_9')_{0-3}$ denotes from 0 to 3 identical or different substituents from the group $C_1$–$C_4$alkyl, $C_1$–$C_4$alkoxy, halogen, carboxy and sulfo. The radicals of formulae (5a) to (5e) are of special interest.

The radical of a formazan chromophore is preferably a radical of formula (7a)

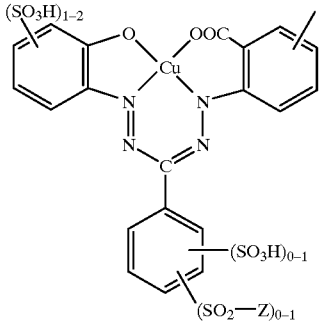

or

-continued (7b)

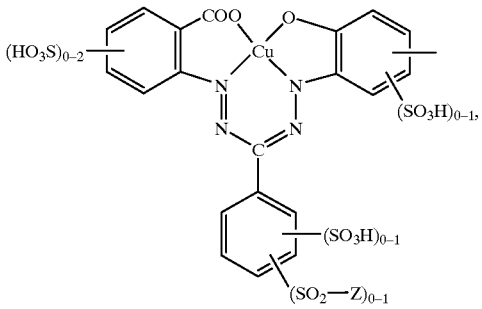

wherein Z is as defined above and the benzene nuclei do not contain any further substituents or are further substituted by $C_1$–$C_4$alkyl, $C_1$–$C_4$alkoxy, $C_1$–$C_4$alkylsulfonyl, halogen or by carboxy. The radicals of formulae (7a) and (7b) preferably contain no further substituents and no radical $-SO_2$-Z.

The radical of a phthalocyanine chromophore is preferably a radical of formula (8)

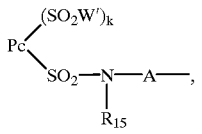

wherein Pc is the radical of a metal phthalocyanine, especially the radical of a copper or nickel phthalocyanine, W' is -OH and/or $-NR_{16}R_{16}'$ and $R_{16}$ and $R_{16}'$ are each independently of the other hydrogen or $C_1$–$C_4$alkyl that is unsubstituted or substituted by hydroxy or by sulfo, $R_{15}$ is hydrogen or $C_1$–$C_4$alkyl, A is a phenylene radical that is unsubstituted or substituted by $C_1$–$C_4$alkyl, halogen, carboxy or by sulfo or is a $C_2$–$C_6$alkylene radical and k is from 1 to 3.

The radical of a dioxazine chromophore is preferably a radical of formula (9)

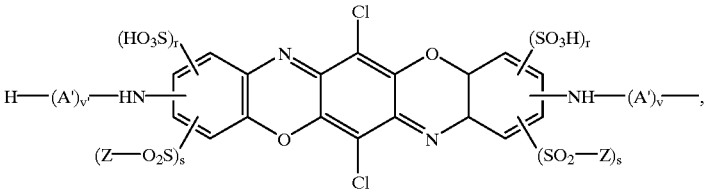

wherein A' is a phenylene radical that is unsubstituted or substituted by $C_1$–$C_4$alkyl, halogen, carboxy or by sulfo or is a $C_2$–$C_6$alkylene radical, r, s, v and v' are each independently of the other the number 0 or 1 and Z is as defined above.

The radical of an anthraquinone chromophore is preferably a radical of formula (10)

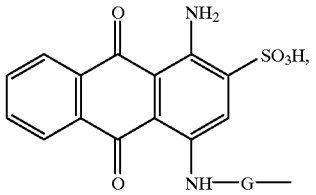

wherein G is a phenylene radical that is unsubstituted or substituted by $C_1$–$C_4$alkyl, $C_1$–$C_4$-alkoxy, halogen, carboxy or by sulfo or is a cyclohexylene, phenylenemethylene or $C_2$–$C_6$-alkylene radical.

The radicals $A_1$, $A_2$ and $A_3$ are preferably radicals of formulae (5a) to (5e), (6a) to (6d), (7a), (7b), (8), (9) or (10), the radicals of formulae (6a) to (6d), (7a) and (7b) preferably containing no fibre-reactive radical. The radicals of formulae (5a) to (5e), (7a), (7b) and (10), especially the radicals of formulae (5a), (5b), (5c) and (5e), are of special interest.

The radicals $A_1$, $A_2$ and $A_3$ preferably each contain from 1 to 4 sulfo groups and preferably from 1 to 3 sulfo groups.

The reactive dyes of formulae (1) and (2) each contain at least two fibre-reactive groups. For example, the reactive dye of formula (1) contains two fibre-reactive triazine radicals and the reactive dye of formula (2) contains a fibre-reactive triazine radical and a fibre-reactive radical V. The reactive dyes of formulae (1) and (2) preferably each contain only two fibre-reactive groups.

Special interest is accorded to reactive dyes of formulae (11a)
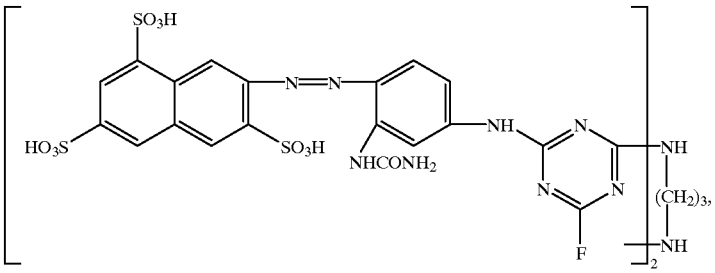
(11b)
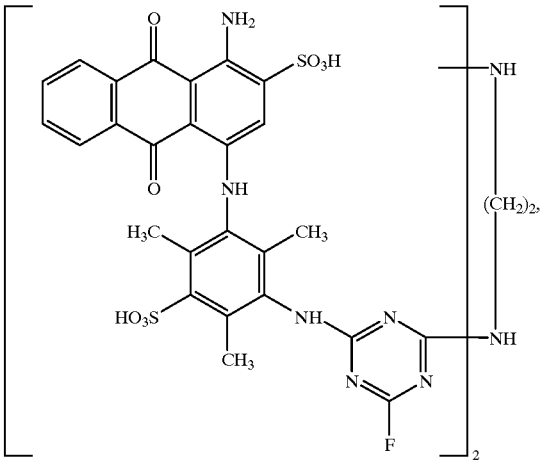
(11c)
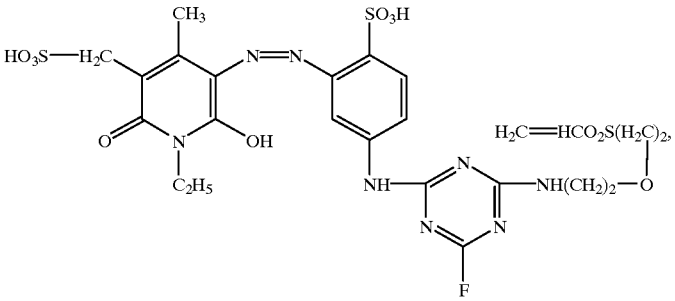
(11d)
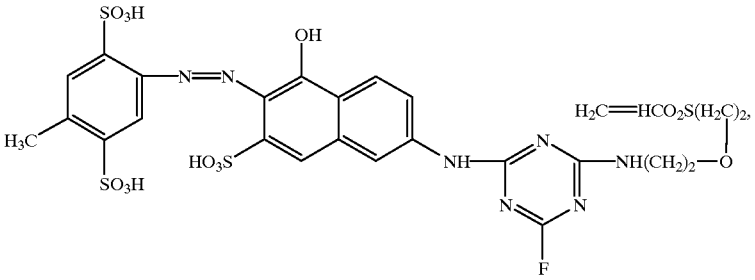
(11e)
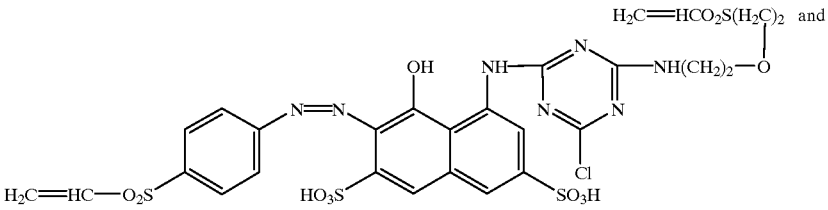

-continued

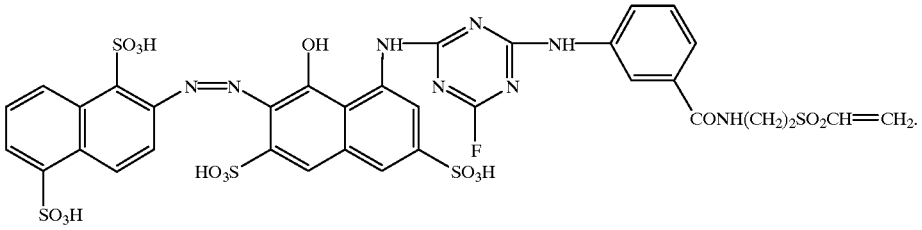

(11f)

The reactive dyes of formulae (1) and (2) are known or can be obtained analogously to known compounds, e.g. by customary diazotisation, coupling and condensation reactions.

The reactive dyes of formulae (1) and (2) used in the inks should preferably have a low salt content, that is to say they should have a total content of salts of less than 0.5% by weight, based on the weight of the dyes. Reactive dyes that have relatively high salt contents as a result of their preparation and/or as a result of the subsequent addition of diluents can be desalted, for example, by membrane separation procedures, such as ultrafiltration, reverse osmosis or dialysis.

The inks preferably comprise as dyes exclusively sulfo-group-containing, water-soluble reactive dyes, such as those of the above formulae (1) and (2).

The inks preferably have a total content of reactive dyes of the above formulae (1) and (2) of from 5 to 35% by weight, especially from 10 to 35% by weight and more especially from 10 to 20% by weight, based on the total weight of the ink.

Suitable water-soluble, non-ionic cellulose ethers are, for example, methyl-, ethyl-, hydroxyethyl-, methylhydroxyethyl-, hydroxypropyl- and hydroxypropylmethyl-cellulose. Methylcellulose and especially hydroxyethylcellulose are preferred. The cellulose ethers are used in the ink usually in an amount of from 0.01 to 2% by weight, especially from 0.01 to 1% by weight and more especially from 0.01 to 0.5% by weight, based on the total weight of the ink.

Suitable alginates are especially alkali alginates and preferably sodium alginate. They are used in the ink usually in an amount of from 0.01 to 2% by weight, especially from 0.01 to 1% by weight and more especially from 0.01 to 0.5% by weight, based on the total weight of the ink.

Both the water-soluble, non-ionic cellulose ethers used and the alginates are used as so-called thickeners and enable an ink of a specific viscosity to be obtained.

Preference is given to inks having a viscosity of from 1 to 40 mPa·s, especially from 5 to 40 mPa·s and more especially from 10 to 40 mPa·s. Inks having a viscosity of from 10 to 30 mPa·s are especially preferred.

The inks may also comprise buffer substances, e.g. borax, borates or citrates. Examples that may be mentioned include sodium borate, sodium tetraborate and sodium citrate. They are used especially in amounts of from 0.1 to 3% by weight, preferably from 0.1 to 1% by weight, based on the total weight of the ink, in order to establish a pH value of, for example, from 5 to 9, especially from 6 to 8. In the case of alginate-containing inks it is preferable to use a citrate buffer.

As further additives the inks may comprise, for example, N-methyl-2-pyrrolidone or especially 1,2-propylene glycol. They are used in the ink usually in an amount of from 5 to 30% by weight, especially from 5 to 20% by weight and more especially from 10 to 20% by weight, based on the total weight of the ink.

The inks may also comprise customary additives, such as antifoam agents or especially substances that inhibit the growth of fungi and/or bacteria. Such additives are usually used in amounts of from 0.01 to 1% by weight, based on the total weight of the ink.

The process for printing textile fibre materials according to the invention can be carried out using ink-jet printers that are known per se and are suitable for textile printing.

In ink-jet printing, individual drops of the ink are sprayed onto a substrate in a controlled manner from a nozzle. For this purpose, predominantly the continuous ink-jet method and the drop-on-demand method are used. In the continuous ink-jet method, the drops are produced continuously and any drops not required for the printing are conveyed to a collecting vessel and recycled. In the drop-on-demand method, however, drops are produced and printed as required; that is to say drops are produced only when required for the printing. The production of the drops can be effected, for example, by means of a piezo-inkjet head or by means of thermal energy (bubble jet). For the process according to the invention, printing in accordance with the drop-on-demand method, especially using a piezo-inkjet head, is preferred.

Textile fibre materials that come into consideration are especially hydroxy-group-containing fibre materials. Preference is given to cellulosic fibre materials that consist wholly or partly of cellulose. Examples are natural fibre materials, such as cotton, linen and hemp, and regenerated fibre materials, for example viscose and lyocell. Special preference is given to viscose and especially cotton. The said fibre materials are preferably in the form of sheet-form textile woven fabrics, knitted fabrics or webs.

According to a preferred embodiment of the present invention, prior to printing the fibre material is subjected to a pretreatment in which the fibre material to be printed is first treated with an aqueous alkaline liquor and the treated fibre material is optionally dried.

The aqueous alkaline liquor comprises at least one of the customary bases used for fixing the reactive dyes in conventional reactive printing processes. The base is used, for example, in an amount of from 10 to 100 g/l of liquor, preferably from 10 to 50 g/l of liquor. Suitable bases are, for example, sodium carbonate, sodium hydroxide, disodium phosphate, trisodium phosphate, sodium acetate, sodium propionate, sodium hydrogen carbonate, aqueous ammonia or sources of alkali, such as sodium chloroacetate or sodium formate. It is preferable to use sodium hydrogen carbonate, sodium carbonate or a mixture of water glass and sodium carbonate. The pH value of the alkaline liquor is generally from 7.5 to 13.5, preferably from 8.5 to 12.5. In addition to the bases, the aqueous alkaline liquor may also comprise further additives, e.g. hydrotropic agents. The hydrotropic agent preferably used is urea, which is used, for example, in an amount of from 25 to 200 g/l of liquor, preferably from 50 to 150 g/l of liquor.

Preferably the fibre material is dried after the above pretreatment.

After printing, the fibre material is advantageously dried, preferably at temperatures of up to 150° C., especially from 80 to 120° C., and then subjected to a heat treatment process in order to complete the print, that is to say to fix the dye.

The heat treatment can be carried out, for example, by means of a hot batch process, a thermosol process or, preferably, by means of a steaming process.

In the case of the steaming process the printed fibre material is subjected, for example, to treatment in a steamer with steam which is optionally superheated, advantageously at a temperature of from 95 to 180° C., more especially in saturated steam.

Subsequently the printed fibre material is generally washed off with water in customary manner in order to remove unfixed dye.

The present invention relates also to aqueous printing inks for the ink-jet printing process, comprising a) from 5 to 35% by weight of at least one reactive dye of the above formula (1) or at least one reactive dye of the above formula (2) and b) from 0.01 to 2% by weight of a water-soluble, non-ionic cellulose ether or an alginate.

The printing inks and the reactive dyes of formulae (1) and (2) are subject to the definitions and preferences mentioned hereinabove.

The prints obtainable according to the process of the invention have good allround properties; for example, they have a high degree of fibre-dye bond stability in both the acidic and the alkaline range, good fastness to light, good fastness to wetting, such as fastness to washing, to water, to seawater, to crossdyeing and to sweat, and good fastness to chlorine, fastness to rubbing, fastness to hot pressing and fastness to pleating, as well as sharp outlines and a high colour strength. The printing inks used are distinguished by good stability and good viscosity characteristics. For example, the viscosity remains virtually unchanged even when high shear forces occur during the printing.

The following Examples serve to illustrate the invention. The temperatures are given in degrees Celsius, parts are parts by weight and percentages relate to percent by weight, unless otherwise indicated. Parts by weight relate to parts by volume in a ratio of kilograms to liters.

EXAMPLE 1 a) Mercerised cotton satin is pad-dyed with a liquor comprising 30 g/l of sodium carbonate (liquor pick-up 70%) and dried.

b) The cotton satin pretreated in accordance with Step a) is printed with an aqueous ink containing

- 15% by weight of the reactive dye of formula (IIa)

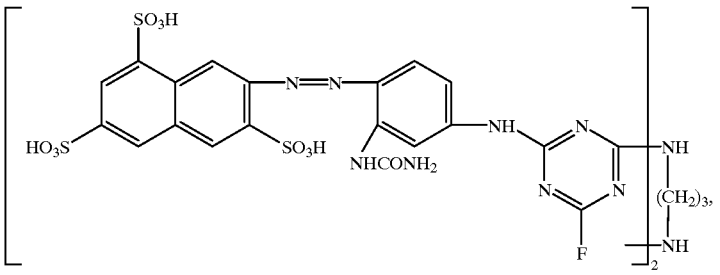

- 0.3% by weight of hydroxyethylcellulose,
- 0.5% by weight of borax and
- 84.2% by weight of water using a continuous flow ink-jet head. The print is dried completely and fixed for 4 minutes at 102° C. in saturated steam, cold-rinsed, washed off at boiling, rinsed again and dried. A yellow print having very good fastness to washing is obtained.

EXAMPLE 2 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink containing

- 15% by weight of the reactive dye of formula (11b)

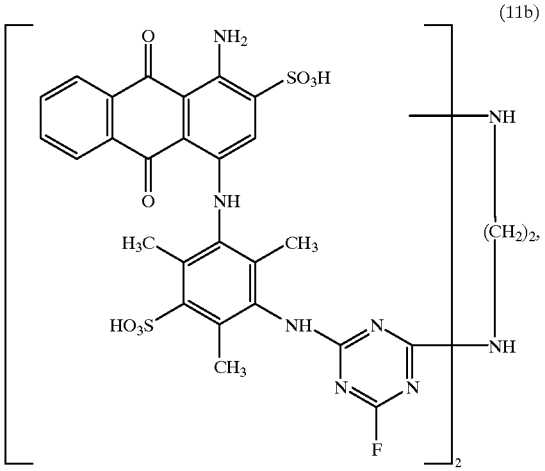

- 0.3% by weight of hydroxyethylcellulose,

- 15% by weight of 1,2-propylene glycol
- 0.5% by weight of borax and
- 69.2% by weight of water using a drop-on-demand piezo-inkjet head. The print is dried completely and fixed for 4 minutes at 102° C. in saturated steam, cold-rinsed, washed off at boiling, rinsed again and dried. A blue print having very good fastness to washing is obtained.

EXAMPLE 3 a) Causticized woven viscose fabric is pad-dyed with a liquor comprising 30 g/l of sodium carbonate and 100 g/l of urea (liquor pick-up 70%) and dried.

b) The causticized woven viscose fabric pretreated in accordance with Step a) is printed with an aqueous ink containing

- 15% by weight of the reactive dye of formula (11c)

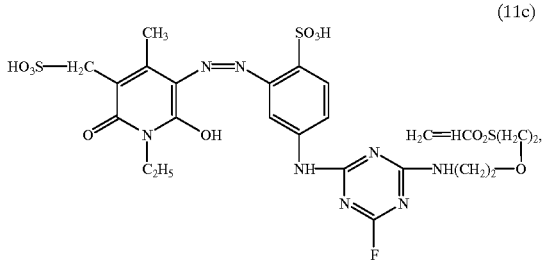

- 0.3% by weight of hydroxyethylcellulose,
- 15% by weight of N-methyl-2-pyrrolidone,
- 0.5% by weight of borax and
- 69.2% by weight of water using a drop-on-demand piezo-inkjet head. The print is dried completely and fixed for 4 minutes at 102° C. in saturated steam, cold-rinsed, washed off at boiling, rinsed again and dried. A yellow print having very good fastness to washing is obtained.

EXAMPLE 4 a) Causticized woven viscose fabric is pad-dyed with a liquor comprising 30 g/l of sodium carbonate and 150 g/l of urea (liquor pick-up 70%) and dried.

b) The causticized woven viscose fabric pretreated in accordance with Step a) is printed with an aqueous ink containing

- 15% by weight of the reactive dye of formula (11d)

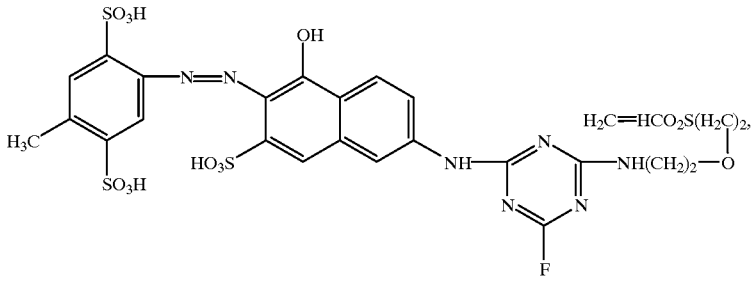

- 0.3% by weight of hydroxyethylcellulose,
- 0.5% by weight of borax and
- 84.2% by weight of water using a continuous flow ink-jet head. The print is dried completely and fixed for 4 minutes at 102° C. in saturated steam, cold-rinsed, washed off at boiling, rinsed again and dried. An orange print having very good fastness to washing is obtained.

EXAMPLE 5 a) Mercerised cotton satin is pad-dyed with a liquor comprising 30 g/l of sodium carbonate (liquor pick-up 70%) and dried.

b) The cotton satin pretreated in accordance with Step a) is printed with an aqueous ink containing

- 15% by weight of the reactive dye of formula (11e)

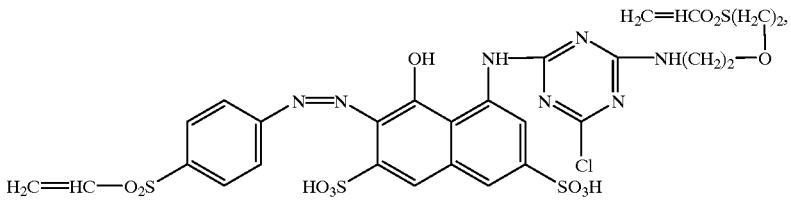

- 0.3% by weight of hydroxyethylcellulose und
- 84.7% by weight of water using a continuous flow ink-jet head. The print is dried completely and fixed for 4 minutes at 102° C. in saturated steam, cold-rinsed, washed off at boiling, rinsed again and dried. A red print having very good fastness to washing is obtained.

EXAMPLE 6 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink containing -15% by weight of the reactive dye of formula

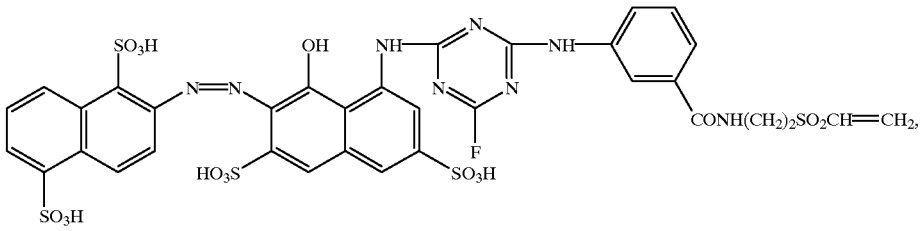

(11f)

- 0.3% by weight of hydroxyethylcellulose,
- 0.5% by weight of sodium citrate and
- 84.2% by weight of water using a continuous flow ink-jet head. The print is dried completely and fixed for 4 minutes at 102° C. in saturated steam, cold-rinsed, washed off at boiling, rinsed again and dried. A red print having very good fastness to washing is obtained.

EXAMPLE 7 a) Mercerised cotton satin is pad-dyed with a liquor comprising 30 g/l of sodium carbonate (liquor pick-up 70%) and dried.

b) The cotton satin pretreated in accordance with Step a) is printed with an aqueous ink containing

- 15% by weight of the reactive dye of formula (11a),
- 0.3% by weight of sodium alginate,
- 0.5% by weight of sodium citrate and
- 84.2% by weight of water using a continuous flow ink-jet head. The print is dried completely and fixed for 4 minutes at 102° C. in saturated steam, cold-rinsed, washed off at boiling, rinsed again and dried. A yellow print having very good fastness to washing is obtained.

EXAMPLE 8 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink containing

- 15% by weight of the reactive dye of formula (11b),
- 0.3% by weight of sodium alginate,
- 15% by weight of 1,2-propylene glycol
- 0.5% by weight of sodium citrate and
- 69.2% by weight of water using a drop-on-demand piezo-inkjet head. The print is dried completely and fixed for 4 minutes at 102° C. in saturated steam, cold-rinsed, washed off at boiling, rinsed again and dried. A blue print having very good fastness to washing is obtained.

EXAMPLE 9 a) Causticized woven viscose fabric is pad-dyed with a liquor comprising 30 g/l of sodium carbonate and 100 g/l of urea (liquor pick-up 70%) and dried.

b) The causticized woven viscose fabric pretreated in accordance with Step a) is printed with an aqueous ink containing

- 15% by weight of the reactive dye of formula (11c),
- 0.3% by weight of sodium alginate,
- 15% by weight of N-methyl-2-pyrrolidone,
- 0.5% by weight of sodium citrate and
- 69.2% by weight of water using a drop-on-demand piezo-inkjet head. The print is dried completely and fixed for 4 minutes at 102° C. in saturated steam, cold-rinsed, washed off at boiling, rinsed again and dried. A yellow print having very good fastness to washing is obtained.

EXAMPLE 10 a) Causticized woven viscose fabric is pad-dyed with a liquor comprising 30 g/l of sodium carbonate and 150 g/l of urea (liquor pick-up 70%) and dried.

b) The causticized woven viscose fabric pretreated in accordance with Step a) is printed with an aqueous ink containing

- 15% by weight of the reactive dye of formula (11d),
- 0.3% by weight of sodium alginate,
- 0.5% by weight of sodium citrate and
- 84.2% by weight of water using a continuous flow ink-jet head. The print is dried completely and fixed for 4 minutes at 102° C. in saturated steam, cold-rinsed, washed off at boiling, rinsed again and dried. An orange print having very good fastness to washing is obtained.

EXAMPLE 11 a) Mercerised cotton satin is pad-dyed with a liquor comprising 30 g/l of sodium carbonate (liquor pick-up 70%) and dried.

b) The cotton satin pretreated in accordance with Step a) is printed with an aqueous ink containing

- 15% by weight of the reactive dye of formula (11e),
- 0.3% by weight of sodium alginate and
- 84.7% by weight of water using a continuous flow ink-jet head. The print is dried completely and fixed for 4 minutes at 102° C. in saturated steam, cold-rinsed, washed off at boiling, rinsed again and dried. A red print having very good fastness to washing is obtained.

EXAMPLE 12 a) Mercerised cotton satin is pad-dyed with a liquor comprising 30 g/l of sodium carbonate and 50 g/l of urea (liquor pick-up 70%) and dried.

b) The cotton satin pretreated in accordance with Step a) is printed with an aqueous ink containing

- 15% by weight of the reactive dye of formula (11f),
- 0.3% by weight of sodium alginate,
- 0.5% by weight of sodium citrate and
- 84.2% by weight of water using a continuous flow ink-jet head. The print is dried completely and fixed for 4 minutes at 102° C. in saturated steam, cold-rinsed, washed off at boiling, rinsed again and dried. A red print having very good fastness to washing is obtained.

What is claimed is:

1. A process for printing textile fibre materials in accordance with the ink-jet printing process, wherein the fibre materials are printed with an aqueous ink comprising a) at least one reactive dye of formula (1)

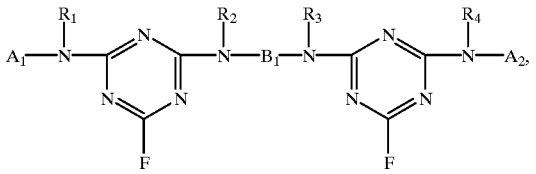

wherein $R_1$, $R_2$, $R_3$ and $R_4$ are each independently of the others hydrogen or unsubstituted or substituted $C_1$–$C_4$alkyl, $B_1$ is an organic bridge member, $A_1$ is the radical of a monoazo, polyazo, metal-complexed azo, anthraquinone, phthalocyanine, formazan or dioxazine chromophore having at least one sulfo group, and $A_2$ is as defined for $A_1$ or is hydrogen or unsubstituted or substituted $C_1$–$C_4$alkyl, phenyl or naphthyl, or at least one reactive dye of formula (2)

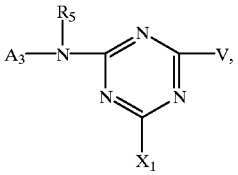

wherein $R_5$ is hydrogen or unsubstituted or substituted $C_1$–$C_4$alkyl, $X_1$ is halogen, $A_3$ is the radical of a monoazo, polyazo, metal-complexed azo, anthraquinone, phthalocyanine, formazan or dioxazine chromophore having at least one sulfo group, and V is a fibre-reactive radical of formula (3a)

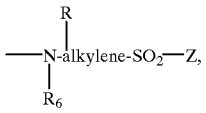

-continued (3b)

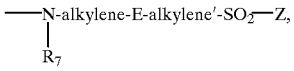

(3c)

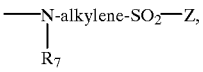

(3d)

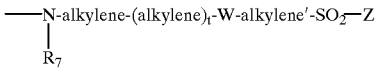

or (3e)

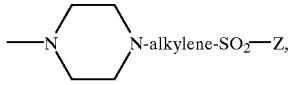

wherein alkylene and alkylene' are each independently of the other $C_1$–$C_6$alkylene, arylene is a phenylene or naphthylene radical that is unsubstituted or substituted by sulfo, carboxy, $C_1$–$C_4$alkyl, $C_1$–$C_4$alkoxy or by halogen, Z is vinyl or a radical $-CH_2-CH_2-U_1$ and $U_1$ is a leaving group, R is hydrogen, hydroxy, sulfo, sulfato, carboxy, cyano, halogen, $C_1$–$C_4$alkoxycarbonyl, C1-C4-alkanoyloxy, carbamoyl or the group $-SO_2-Z$, $R_6$ is hydrogen, $C_1$–$C_4$alkyl that is unsubstituted or substituted by hydroxy, sulfo, sulfato, carboxy or by cyano, or a radical of the formula

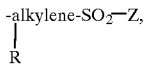

$R_7$ is hydrogen or $C_1$–$C_4$alkyl that is unsubstituted or substituted by carboxy, cyano, hydroxy, sulfo or by sulfato, E is the radical -O- or $-NR_8-$ and $R_8$ is hydrogen or $C_1$–$C_4$alkyl, W is a group of the formula $-SO_2-NR_6-$, $-CONR_6-$ or $-NR_6CO-$ and $R_6$ is as defined above, and t is 0 or 1, and b) a water-soluble, non-ionic cellulose ether or an alginate.

2. A process according to claim 1, wherein $R_1$, $R_2$, $R_3$, $R_4$ and $R_5$ are each independently of the others hydrogen or $C_1$–$C_4$alkyl.

3. A process according to claim 1, wherein $B_1$ is a $C_2$–$C_{12}$alkylene radical which may be interrupted by 1, 2 or 3 members from the group -NH-, $-N(CH_3)-$ and -O- and is unsubstituted or substituted by hydroxy, sulfo, sulfato, cyano or by carboxy.

4. A process according to claim 1, wherein $X_1$ is fluorine or chlorine.

5. A process according to claim 1, wherein V is a radical of formula (3b) or (3d).

6. A process according to claim 1, wherein alkylene and alkylene' are each independently of the other $C_2$–$C_3$alkylene, $R_7$ is hydrogen, Z is vinyl or a radical of the formula $-CH_2-CH_2-OSO_3H$, E is the radical -O-, W is a group of the formula -CONH- and t is the number 0.

7. A process according to claim 1, wherein $A_1$, $A_2$ and $A_3$ are each independently of the others a radical of formula (5a)

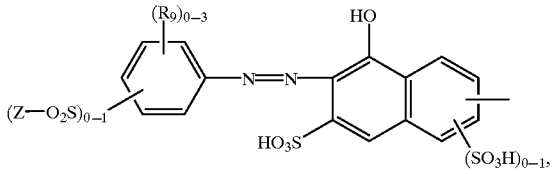

wherein $(R_9)_{0-3}$ denotes from 0 to 3 identical or different substituents from the group $C_1$–$C_4$alkyl, $C_1$–$C_4$alkoxy, halogen, carboxy and sulfo and Z is as defined in claim 1, (5b)

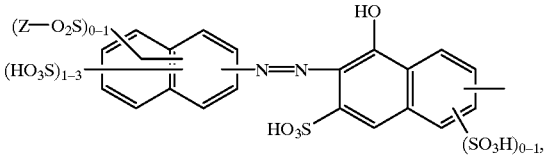

wherein Z is as defined in claim 1, (5c)

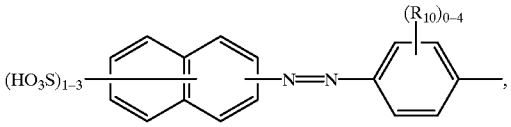

wherein $(R_{10})_{0-4}$ denotes from 0 to 4 identical or different substituents from the group halogen, nitro, cyano, trifluoromethyl, sulfamoyl, carbamoyl, $C_1$–$C_4$alkyl, $C_1$–$C_4$alkoxy, amino, acetylamino, ureido, hydroxy, carboxy, sulfomethyl and sulfo and Z is as defined in claim 1, (5d)

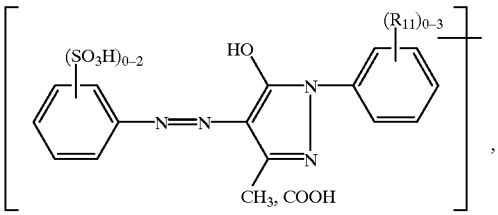

wherein $(R_{11})_{0-3}$ denotes from 0 to 3 identical or different substituents from the group $C_1$–$C_4$alkyl, $C_1$–$C_4$alkoxy, halogen, carboxy and sulfo, (5e)

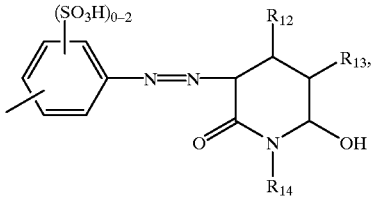

wherein $R_{12}$ and $R_{14}$ are each independently of the other hydrogen, $C_1$–$C_4$alkyl or phenyl, and $R_{13}$ is hydrogen, cyano, carbamoyl or sulfomethyl, (6a)

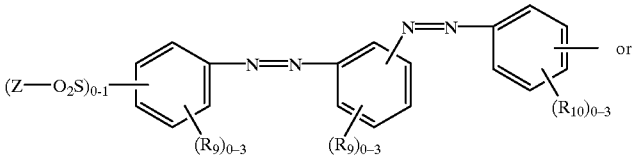

(6b)

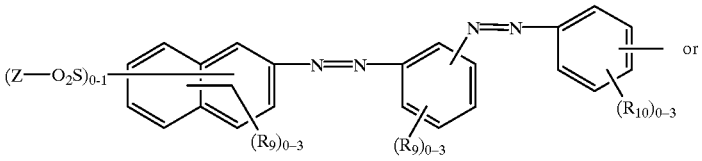

(6c)

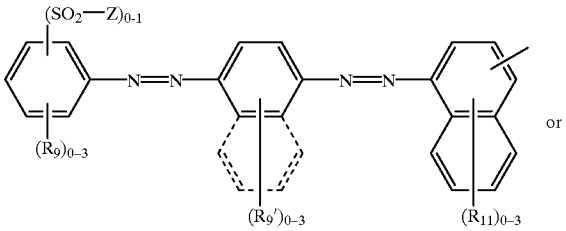

-continued (6d)

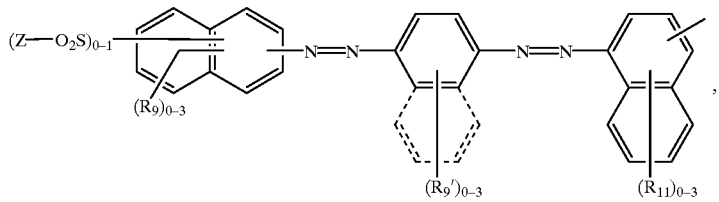

wherein $(R_9)_{0-3}$, $(R_{10})_{0-3}$, $(R_{11})_{0-3}$ and Z are each as defined above and $(R_9')_{0-3}$ denotes from 0 to 3 identical or different substituents from the group $C_1$–$C_4$alkyl, $C_1$–$C_4$alkoxy, halogen, carboxy and sulfo, (7a)

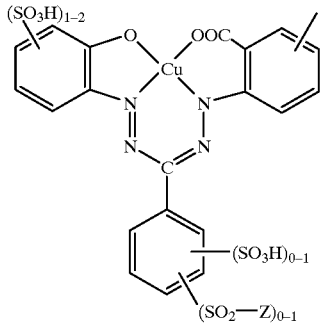

or (7b)

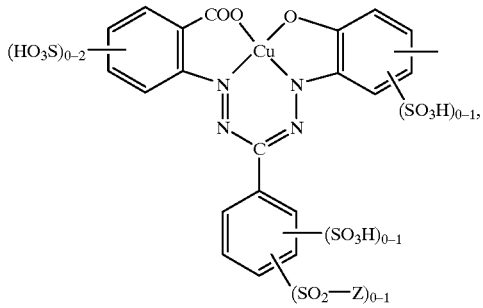

wherein Z is as defined above and the benzene nuclei do not contain any further substituents or are further substituted by $C_1$–$C_4$alkyl, $C_1$–$C_4$alkoxy, $C_1$–$C_4$alkylsulfonyl, halogen or by carboxy, (8)

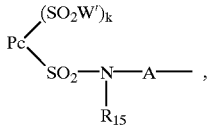

wherein Pc is the radical of a metal phthalocyanine,

W' is -OH and/or $-NR_{16}R_{16}'$ and $R_{16}$ and $R_{16}'$ are each independently of the other hydrogen or $C_1$–$C_4$alkyl that is unsubstituted or substituted by hydroxy or by sulfo, $R_{15}$ is hydrogen or $C_1$–$C_4$alkyl, A is a phenylene radical that is unsubstituted or substituted by $C_1$–$C_4$alkyl, halogen, carboxy or by sulfo or is a $C_2$–$C_6$alkylene radical and k is from 1 to 3, (9)

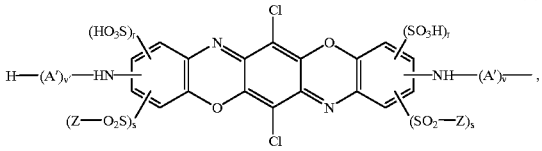

wherein A' is a phenylene radical that is unsubstituted or substituted by $C_1$–$C_4$alkyl, halogen, carboxy or by sulfo or is a $C_2$–$C_6$alkylene radical, r, s, v and v' are each independently of the other the number 0 or 1 and Z is as defined above, or (10)

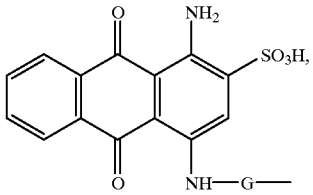

wherein G is a phenylene radical that is unsubstituted or substituted by $C_1$–$C_4$alkyl, $C_1$–$C_4$-alkoxy, halogen, carboxy or by sulfo or is a cyclohexylene, phenylenemethylene or $C_2$–$C_6$-alkylene radical.

8. A process according to claim 1, wherein there are used as reactive dyes of formula (1) or (2) at least one of the reactive dyes of formulae (11a)
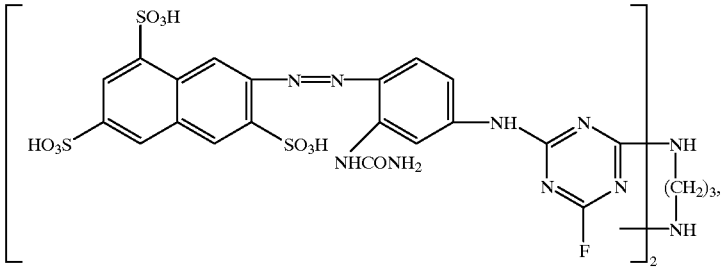
(11b)
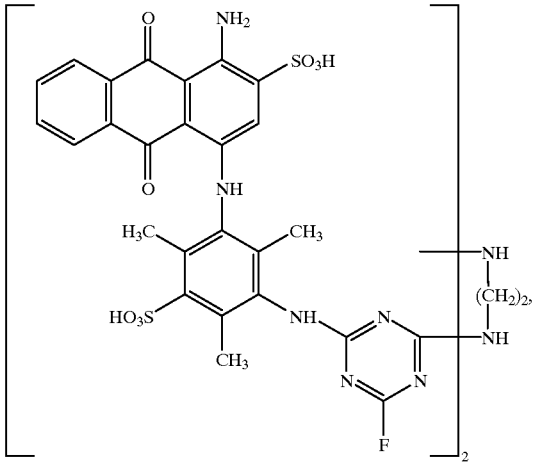
(11c)
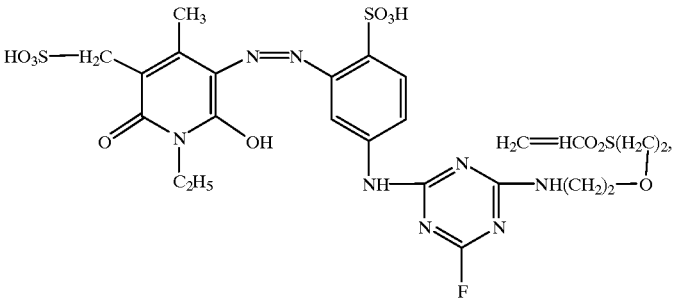
(11d)
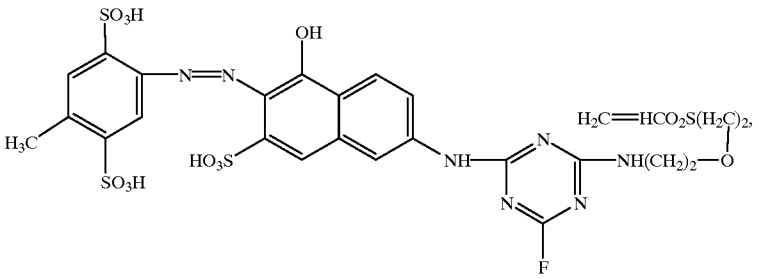
(11e)
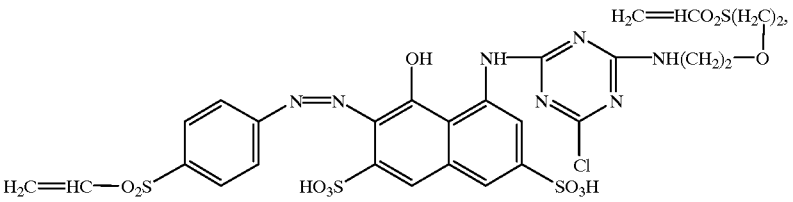
and -continued (11f)

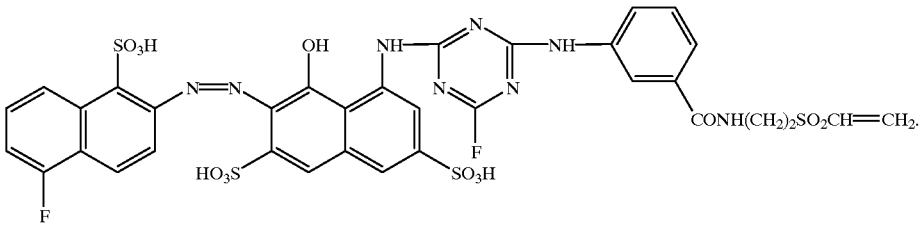

9. A process according to claim 1, wherein the water-soluble, non-ionic cellulose ether used is methylcellulose or hydroxyethylcellulose.

10. A process according to claim 1, wherein said aqueous ink comprises an alginate.

11. A process according to claim 1, wherein said aqueous ink has a viscosity of from 1 to 40 mPa·s.

12. A process according to claim 1, wherein said aqueous ink further comprises a buffer.

13. A process according to claim 1, wherein said fibre materials are cellulosic fibre materials.

14. An aqueous printing ink for the ink-jet printing process, comprising a) from 5 to 35% by weight of at least one reactive dye of formula (1)

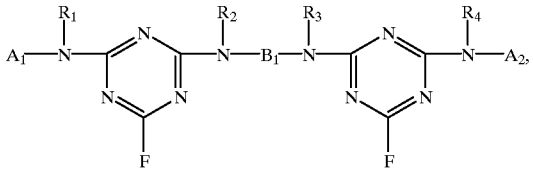

wherein $R_1$, $R_2$, $R_3$ and $R_4$ are each independently of the others hydrogen or unsubstituted or substituted $C_1$–$C_4$alkyl, $B_1$ is an organic bridge member, $A_1$is the radical of a monoazo, polyazo, metal-complexed azo, anthraquinone, phthalocyanine, formazan or dioxazine chromophore having at least one sulfo group, and $A_2$ is as defined for $A_1$ or is hydrogen or unsubstituted or substituted $C_1$–$C_4$alkyl, phenyl or naphthyl, or at least one reactive dye of formula (2)

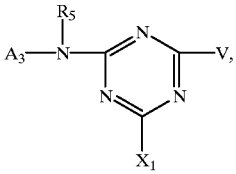

wherein $R_5$ is hydrogen or unsubstituted or substituted $C_1$–$C_4$alkyl, $X_1$ is halogen, $A_3$ is the radical of a monoazo, polyazo, metal-complexed azo, anthraquinone, phthalocyanine, formazan or dioxazine chromophore having at least one sulfo group, and V is a fibre-reactive radical of formula (3a)

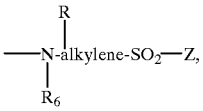

(3b)

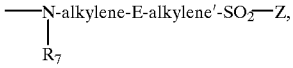

(3c)

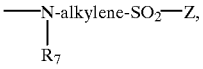

(3d)

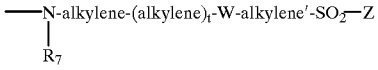

or (3e)

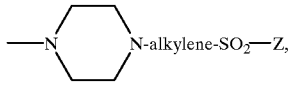

wherein alkylene and alkylene' are each independently of the other $C_1$–$C_6$alkylene, arylene is a phenylene or naphthylene radical that is unsubstituted or substituted by sulfo, carboxy, $C_1$–$C_4$alkyl, $C_1$–$C_4$alkoxy or by halogen, Z is vinyl or a radical $-CH_2-CH_2-U_1$ and $U_1$ is a leaving group, R is hydrogen, hydroxy, sulfo, sulfato, carboxy, cyano, halogen, $C_1$–$C_4$alkoxycarbonyl, $C_1$–$C_4$-alkanoyloxy, carbamoyl or the group $-SO_2-Z$, $R_6$ is hydrogen, $C_1$–$C_4$alkyl that is unsubstituted or substituted by hydroxy, sulfo, sulfato, carboxy or by cyano, or a radical of the formula

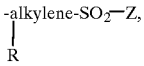

$R_7$ is hydrogen or $C_1$–$C_4$alkyl that is unsubstituted or substituted by carboxy, cyano, hydroxy, sulfo or by sulfato, E is the radical -O- or $-NR_8-$ and $R_8$ is hydrogen or $C_1$–$C_4$alkyl, W is a group of the formula $-SO_2-NR_6-$, $-CONR_6-$ or $-NR_6CO-$ and $R_8$ is as defined above, and t is 0 or 1, and b) from 0.01 to 2% by weight of a water-soluble, non-ionic cellulose ether or an alginate.

15. An aqueous printing ink according to claim 14, comprising from 0.01 to 2% by weight of an alginate.

* * * * *

UNITED STATES PATENT AND TRADEMARK OFFICE

CERTIFICATE OF CORRECTION

PATENT NO. : 5,972,084
DATED : October 26, 1999
INVENTOR(S) : Roger Lacroix et al.

It is certified that error appears in the above-identified patent and that said Letters Patent is hereby corrected as shown below:

Column 22,
Line 7, should read:

$$\text{-- } -\underset{\underset{R_7}{|}}{N}-\text{arylene}-SO_2-Z$$

Line 10, should read:

$$-\underset{\underset{R_7}{|}}{N}-\text{arylene}-(\text{alkylene})_t-W-\text{alkylene}'-SO_2-Z$$

Signed and Sealed this

First Day of October, 2002

*Attest:*

*Attesting Officer*

JAMES E. ROGAN
*Director of the United States Patent and Trademark Office*